US006856285B2

(12) United States Patent
Bettin et al.

(10) Patent No.: US 6,856,285 B2
(45) Date of Patent: Feb. 15, 2005

(54) MULTI-BAND PIF ANTENNA WITH MEANDER STRUCTURE

(75) Inventors: Ulrich Bettin, San Diego, CA (US); Peter Nevermann, San Diego, CA (US)

(73) Assignee: Siemens Information & Communication Mobile, LLC, San Diego, CA (US)

( * ) Notice: Subject to any disclaimer, the term of this patent is extended or adjusted under 35 U.S.C. 154(b) by 125 days.

(21) Appl. No.: 10/108,059

(22) Filed: Mar. 27, 2002

(65) Prior Publication Data

US 2003/0184482 A1 Oct. 2, 2003

Related U.S. Application Data

(63) Continuation-in-part of application No. 10/091,619, filed on Mar. 4, 2002.

(51) Int. Cl.[7] ..... H01Q 1/38
(52) U.S. Cl. ..... 343/700 MS; 343/846
(58) Field of Search ..... 343/700 MS, 795, 343/846, 895, 848

(56) References Cited

U.S. PATENT DOCUMENTS

| | | | | |
|---|---|---|---|---|
| 6,140,967 | A | * 10/2000 | Kolsrud | 343/700 MS |
| 6,204,826 | B1 | * 3/2001 | Rutkowski et al. | 343/895 |
| 6,281,850 | B1 | 8/2001 | Klostermann | |
| 6,380,895 | B1 | * 4/2002 | Moren et al. | 343/700 MS |
| 6,417,816 | B2 | * 7/2002 | Sadler et al. | 343/795 |
| 6,459,413 | B1 | * 10/2002 | Tseng et al. | 343/702 |
| 6,504,511 | B2 | * 1/2003 | Andersson | 343/702 |
| 6,518,937 | B2 | * 2/2003 | Fang | 343/895 |
| 6,529,170 | B1 | * 3/2003 | Nishizawa et al. | 343/795 |
| 2003/0160727 | A1 | * 8/2003 | Ebine et al. | 343/702 |

FOREIGN PATENT DOCUMENTS

| | | |
|---|---|---|
| DE | 199 29 689 A1 | 1/2001 |
| WO | WO 00/16439 | 3/2000 |

* cited by examiner

*Primary Examiner*—Tan Ho

(57) ABSTRACT

A mono-band or multi-band planar inverted F antenna (PIFA) structure comprises a planar radiating element having a first area, and a ground plane having a second area that is substantially parallel to the radiating element first area. The second area further comprises a section having a meandering form elongating the effective overall length of the radiating element.

30 Claims, 5 Drawing Sheets

MULTI-BAND PIF ANTENNA WITH MEANDER STRUCTURE

CROSS-REFERENCE TO RELATED APPLICATION

This application is a continuation-in-part of commonly assigned U.S. patent application Ser. No. 10/091,619 filed Mar. 4, 2002 entitled "Broadband Planar Inverted F Antenna" having inventor Peter Nevermann.

BACKGROUND OF THE INVENTION

The present invention relates generally to antennas and more particularly to a multi-band planar inverted F antenna.

Planar inverted F antennas (PIFAs) are used in wireless communications, e.g., cellular telephones, wireless personal digital assistants (PDAs), wireless local area networks (LANs)—Bluetooth, etc. The PIFA generally includes a planar radiating element having a first area, and a ground plane having a second area that is parallel to the radiating element first area. An electrically conductive first line is coupled to the radiating element at a first contact located at an edge on a side of the radiating element. The first line is also coupled to the ground plane. An electrically conductive second line is coupled to the radiating element along the same side as the first line, but at a different contact location on the edge than the first line. The first and second lines are adapted to couple to a desired impedance, e.g., 50 ohms, at frequencies of operation of the PIFA. In the PIFA, the first and second lines are perpendicular to the edge of the radiating element to which they are coupled, thereby forming an inverted F shape (thus the descriptive name of planar inverted F antenna).

The resonance frequency of the PIFA is determined generally by the area of the radiating element and to a lesser extent the distance between the radiating element and the ground plane (thickness of the PIFA assembly). The bandwidth of the PIFA is generally determined by thickness of the PIFA assembly and the electrical coupling between the radiating element and the ground plane. A significant problem in designing a practical PIFA application is the trade off between obtaining a desired operating bandwidth and reducing the PIFA volume (area×thickness). Furthermore, it is preferable to have a larger ground plane area (shield) because this helps in reducing radio frequency energy that may enter into a user's head (SAR value=specific absorption rate), e.g., from a mobile cellular telephone. However, the volume of the PIFA increases with a larger ground plane area unless the thickness (distance between the radiating element and ground plane areas) is reduced.

As the number of wireless communications applications increases and the physical size of wireless devices decreases, antennas for these applications and devices are needed. Prior known planar inverted F antennas have sacrificed bandwidth by requiring a reduction in the volume (thickness) of the PIFA for a given wireless application.

In addition different markets use different operating frequencies. For example, a new GSM band at 850 MHz was assigned recently in North America. Existing PIF antenna solutions from the European GSM 900 MHz band need to be adapted properly, i.e., the resonance frequency needs to be shifted from 900 MHz to 850 MHz band. It is thus desirable to be able to redesign a wireless communication product for different frequencies with a minimum of design changes.

However, in order to use the same sort of antenna at a lower resonance frequency the physical dimensions need to be changed. As an example, the dimensions of a PIFA designed for 900 MHz need to be scaled by multiplying it with a factor 850/900 to operate at 850 Mhz. Therefore, it is obvious, that the dimensions of the PIF antenna are bigger at 850 MHz. Thus, redesigning a product for a different frequency can cause problems in the redesign of the respective antenna.

Therefore, there is a need for a PIFA design able to operate at a different resonance frequency without having to increase the dimensions thereof.

SUMMARY OF THE INVENTION

The present invention overcomes the above-identified problems as well as other shortcomings and deficiencies of existing technologies by providing an apparatus and a system for increasing the useable bandwidth of a PIFA.

According to an exemplary embodiment, the invention provides antenna including a ground plane and a radiating element. The ground plane has a first planar surface and a first area, and the radiating element has a second planar surface and a second area. The second planar surface of the radiating element is substantially parallel with the first planar surface of the ground plane, and the second area includes a section having a meandering form elongating the effective overall length of the radiating element.

A more complete understanding of the specific embodiments of the present invention and advantages thereof may be acquired by referring to the following description taken in conjunction with the accompanying drawings.

DETAILED DESCRIPTION OF THE SPECIFIC EMBODIMENTS

Figure 1:
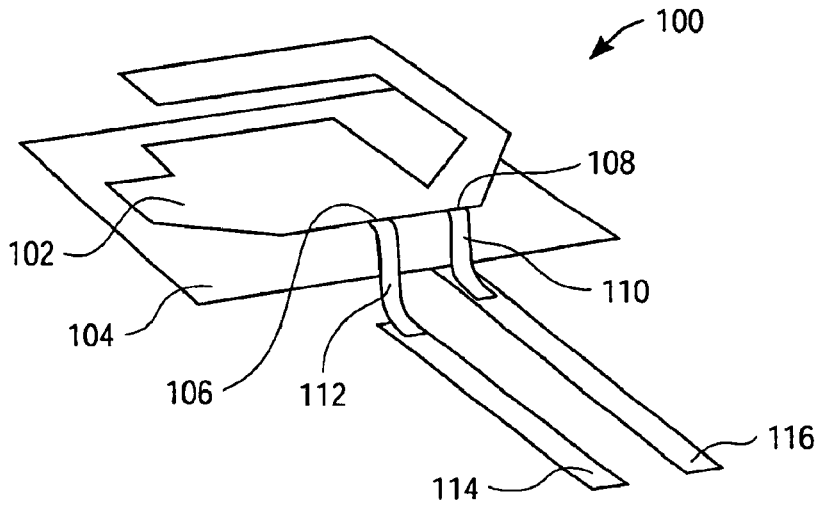
FIG. 1 (Prior Art)
FIG. 1 is a schematic diagram of a prior technology planar inverted F antenna (PIFA)

According to an exemplary embodiment of the invention, an antenna includes a ground plane and a radiating element. The ground plane has a first planar surface and a first area, and the radiating element has a second planar surface and a second area. The second planar surface of the radiating element is substantially parallel with the first planar surface of the ground plane, and the second area comprises a section having a meandering form elongating the effective over all length of the radiating element. The antenna may further comprise a first connecting line and a second connecting line. The first connecting line is coupled to a first edge of the ground plane and to a second edge of the radiating element at a first contact location, and the second connecting line is coupled to the second edge of the radiating element at second and third contact locations. The first area of the ground plane can be greater than the second area of the radiating element or can be substantially the same as the second area of the radiating element. The first contact location can be between the second and third contact locations. Furthermore, the second connecting line can be coupled to the second edge of the radiating element at a plurality of contact locations. The first and second connecting lines can be adapted for a desired impedance, which can be, for example, about 50 ohms. The second area of the radiating element can comprises a first and a second section, wherein one of the sections can comprise at least one sub-section elongating the effective electrical length of the section and the second section can have an L-shaped form. The meandering form can be a sinusoidal, triangular, rectangular or any other suitable wave-like form. The ground plane can be on one side of an insulating substrate and the radiating element can be on the other side of the insulating substrate. Furthermore, the ground plane, the insulating substrate and the radiating element can be flexible. The first area of the ground plane and the second area of the radiating element can be rectangular or non-rectangular.

Another embodiment is a planar inverted F antenna which comprises a ground plane and a radiating element. The ground plane has a first planar surface and a first area, and the radiating element has a second planar surface and a second area. The second planar surface of the radiating element is substantially parallel with the first planar surface of the ground plane, and the second area includes a section having a meandering form elongating the effective over all length of the radiating element. The antenna also includes a first connecting line coupled to an edge of the ground plane and to an edge of the radiating element, and a second connecting line coupled to the edge of the radiating element on either side of where the first connecting line is coupled thereto.

Yet another embodiment is a planar inverted F antenna which includes a ground plane and a radiating element. The ground plane has a first planar surface, a first circumference and a first plurality of edges on the first circumference, and the radiating element has a second planar surface, a second circumference and a second plurality of edges on the second circumference. The second planar surface of the radiating element is substantially parallel with the first planar surface of the ground plane, and the second area includes a section having a meandering form elongating the effective overall length of the radiating element. The antenna also has a first connecting line coupled to a first edge of the first plurality of edges and a first edge of the second plurality of edges, and a second connecting line coupled to the first edge of the second plurality of edges on either side of the first connecting line.

Another embodiment is a radio system having a planar inverted F antenna (PIFA). The system includes a ground plane and a radiating element. The ground plane has a first planar surface and a first area, and the radiating element has a second planar surface and a second area. The second planar surface of the radiating element is substantially parallel with the first planar surface of the ground plane, and the second area includes a section having a meandering form elongating the effective overall length of the radiating element. The system also includes a first connecting line coupled to a first edge of the ground plane and to a second edge of the radiating element at a first contact location, and a second connecting line coupled to the second edge of the radiating element at second and third contact locations. The first and second connecting lines are adapted to couple to a radio at a desired impedance.

Referring now to the drawings, the details of an exemplary specific embodiment of the invention are schematically illustrated. FIG. 1 illustrates a schematic diagram of a prior technology planar inverted F antenna (PIFA). The prior technology PIFA is generally represented by the numeral 100. The PIFA 100 comprises a radiating element 102, a ground plane 104, a first connecting line 110 coupled to the radiating element 102 at contact location 108, and a second connecting line 112 coupled to the radiating element 102 at contact location 106. The first connecting line 110 is also coupled to the ground plane 104 via connection 116. The connecting lines 110 and 112 are adapted for coupling to a radio system (not shown) through connections 114 and 116. The connections 114 and 116 generally are adapted for a desired impedance, e.g., 50 ohms, at frequencies of operation of the PIFA. The connection 114 is generally the "hot" connection, and the connection 116 is generally the ground connection.

Figure 2:
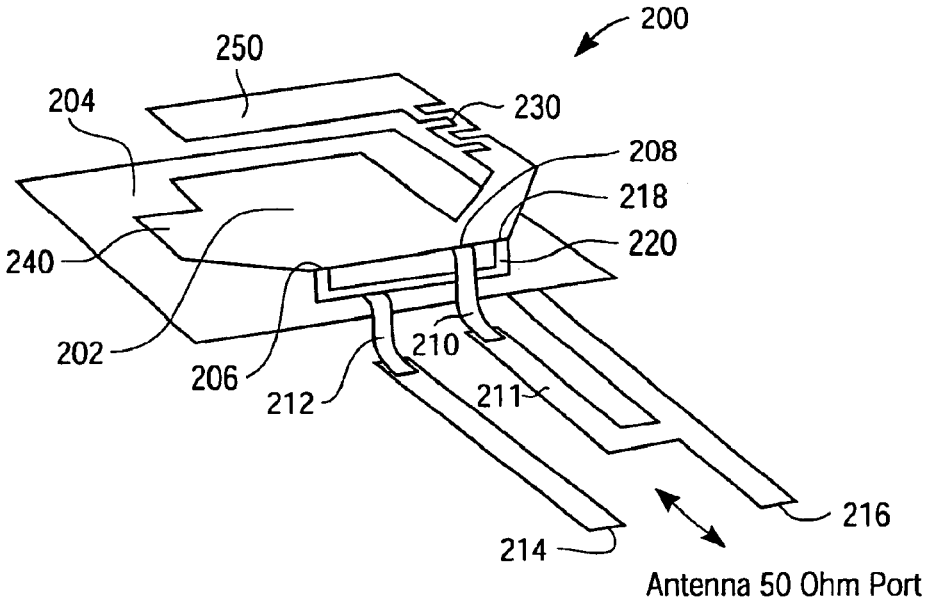
FIG. 2 is a schematic diagram of a first exemplary embodiment of a planar inverted F antenna (PIFA) according to the present invention.

Referring to FIG. 2, depicted is a schematic diagram of an exemplary embodiment of a planar inverted F antenna (PIFA), according to the present invention. This specific exemplary embodiment of a PIFA is generally represented by the numeral 200. The PIFA 200 comprises a radiating element 202, a ground plane 204, a first connecting line 210 coupled to the radiating element 202 at contact location 208, and a second connecting line 212 coupled to a third connecting line 220 which is coupled to the radiating element 202 at contact locations 206 and 218. The first connecting line 210 is also coupled to the ground plane 204 through coupling line 211. The connecting lines 210 and 212 are adapted to be coupled to a radio system (not shown) through connections 214 and 216. The connections 214 and 216 generally are adapted for a desired impedance, e.g., 20 ohms, 50 ohms, 75 ohms, or from about 20 to 300 ohms at frequencies of operation of the PIFA 200. The connection 214 is generally the "hot" connection, and the connection 216 is generally the ground connection. Coupling to the radiating element 202 at multiple contact locations (206, 218) increases the bandwidth of the PIFA 200. According to the shown embodiment, the radiating element 202 includes two sections 240 and 250. Section 250 includes a sub-section 230 comprising a meander structure to elongate section 250.

Generally, the area of the radiating element 202 determines the resonance frequency; whereas, the thickness, namely the distance between the radiating element 202 and the ground plane 204, determines the bandwidth of the PIF antenna. Further, the lower the resonance frequency is, the longer the antenna is or in other words the bigger the size or profile of the antenna. The type of multi-band PIF antenna shown in FIG. 2 comprises substantially two different sections, namely a rectangular section 240 and a L-shaped section 250. Each section has its own resonance frequency. Thus, two frequency bands can be supported by such an antenna. The coupling 220 which connects the "hot" connection 214 with radiating element 202 further enhances the two antenna elements. By means of this connection, both antenna elements are switched in parallel.

According to the present invention, sub-section 230 within antenna section 250 effectively elongates the length of section 250 and thus decreases the resonance frequency without changing the overall size of the antenna.

Figure 3:
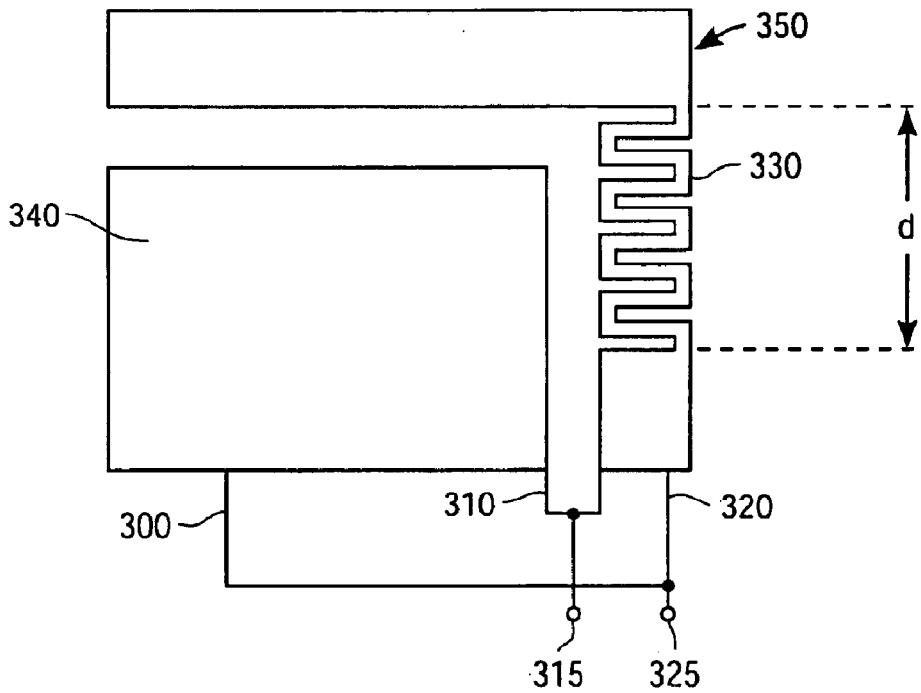
FIGS. 3 and 4 are top views of further exemplary embodiments of the radiation element of a PIFA according to the present invention.

FIG. 3 shows a top view of a radiating element of another embodiment according to the present invention. In this embodiment, the radiating element includes two separate antenna elements 340 and 350 instead of a single element. The first antenna element 340 has a substantially rectangular shape and the second element 350 has a substantially L-type shape. Both elements 340 and 350 can be placed as shown whereby the second L-shaped element 350 partially frames element 340. The ground connection 315 is coupled with connection points of both antenna elements 340 and 350 through a bridge connector 310. The "hot" connection 325 is coupled at connection points to each antenna element 340, 350 through respective wires or transmission lines 300 and 320. According to the present invention, the design of the L-shaped antenna element 350 comprises a sub-section 330 to increase the effective length of the antenna element 350. This sub-section 330 has a meandering form. Manufacture of such an antenna element can achieved by either a stamping procedure, etching process, or any other suitable method using, for example, sheet metal. The L-shaped antenna element 350 has an effective partial length d for sub-section 330. Through the use of a meandering shape, the effective electrical length will become some multiple of length d, thus elongating the respective antenna element 350.

Figure 4:
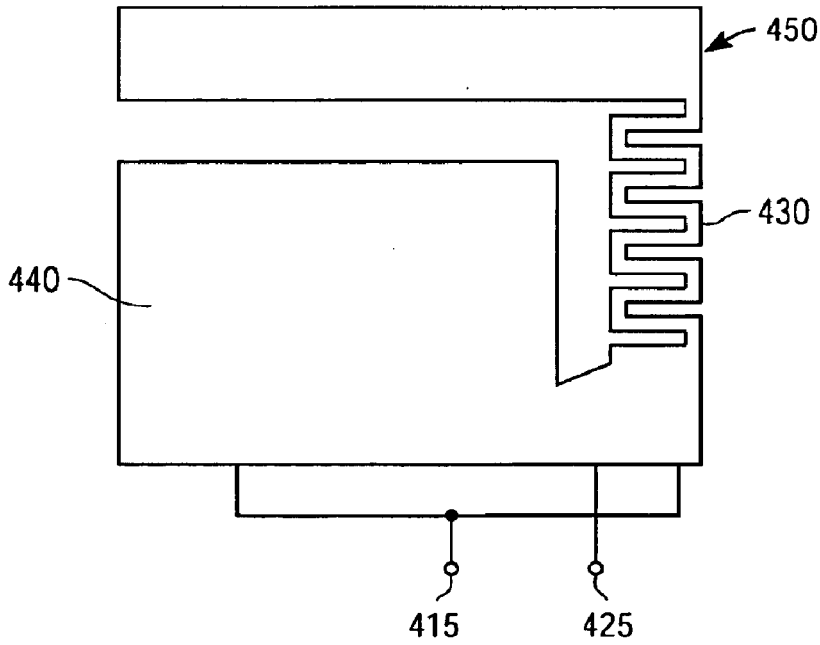
Figure 5A:
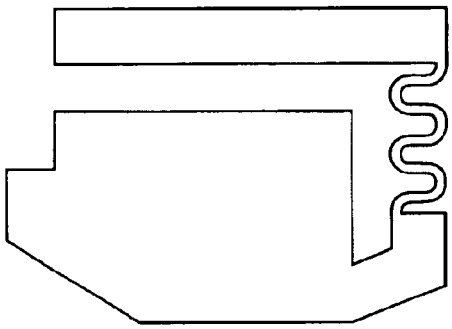
FIGS. 5–7 are top views of different exemplary embodiments of PIFAs showing various shapes of the elongating sub-sections according to the present invention.
Figure 5B:
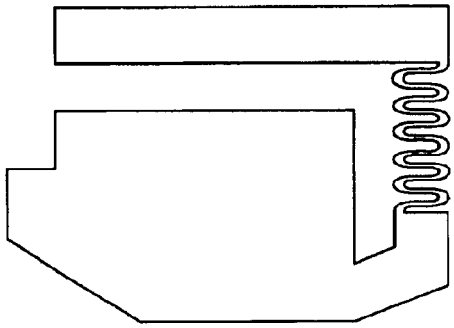
Figure 5C:
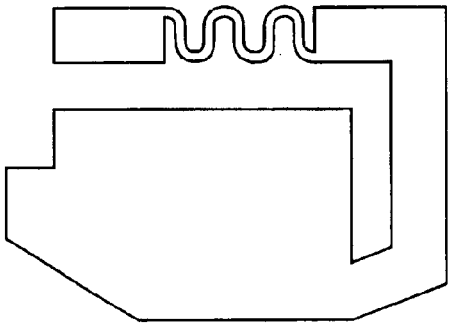
Figure 5D:
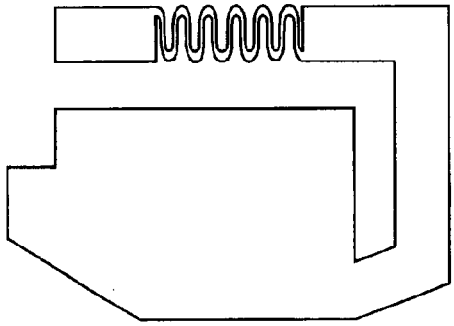
Figure 5E:
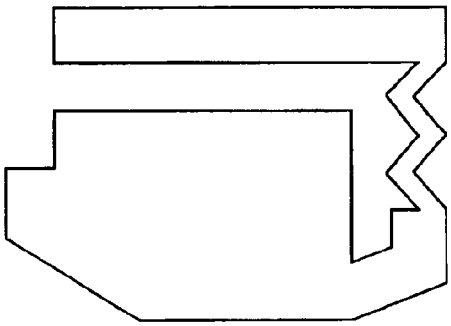
Figure 5F:
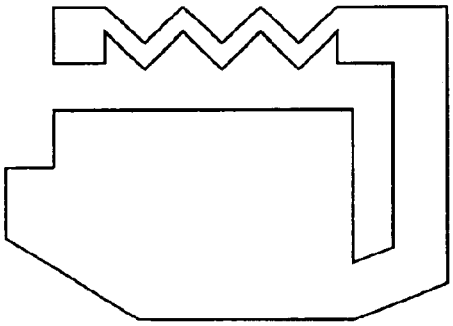
Figure 6A:
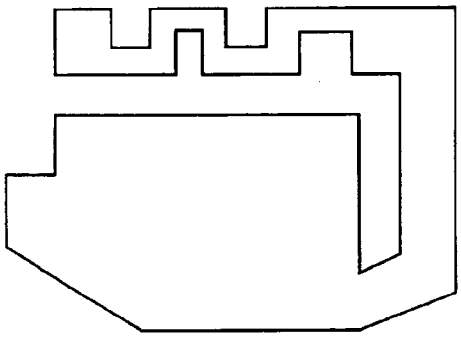
Figure 6B:
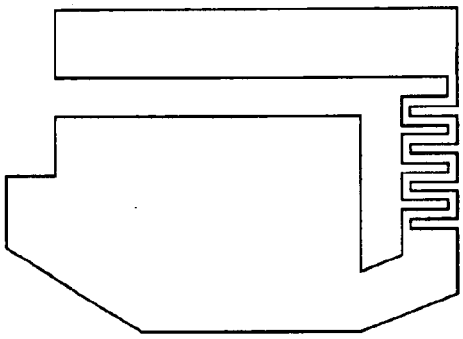
Figure 6C:
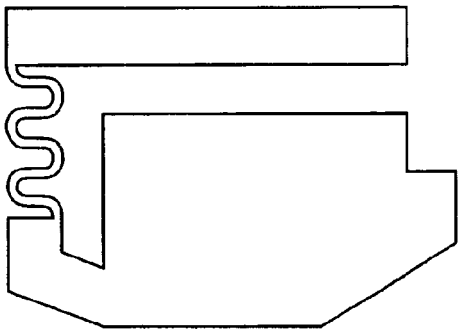
Figure 6D:
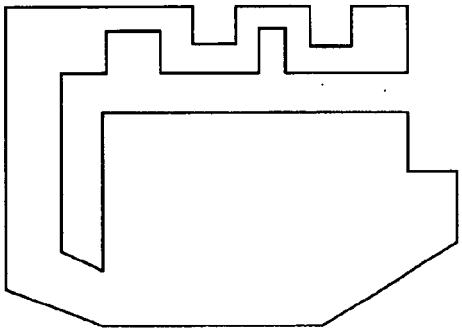
Figure 6E:
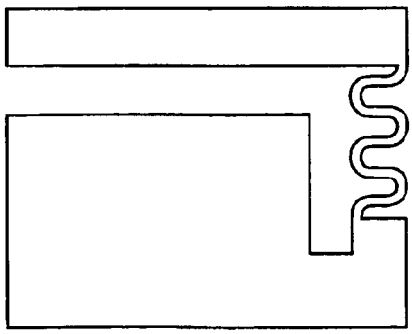
Figure 6F:
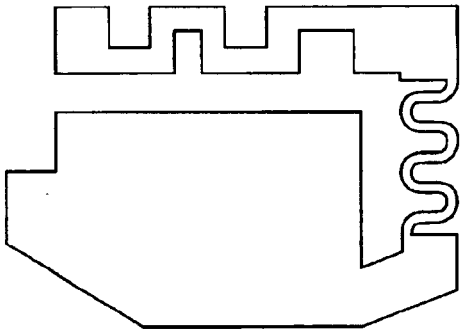

FIG. 4 shows yet another embodiment of the radiating element according to the present invention. In this embodiment, a single sheet metal is used and, for example, is stamped to provide substantially two sections 440 and 450. Section 450 has a sub-section 430 with a meandering structure or shape. Only a single ground connection 425 is needed. This connection is positioned, preferably, at the joint point where both antenna elements are connected. The "hot" connection 415 is placed in a similar manner as shown in FIGS. 2 and 3.

The sub-section of the antenna element comprising a meandering structure or form can have a plurality of different shapes. It is essential, however, that the effective length of the sub-section is longer than the physical length d of this sub-section to elongate the effective overall electrical length of the antenna element. Also, no additional manufacture steps are necessary, as the meander-like structure is formed within the surface plane of the radiating element.

Figure 7A:
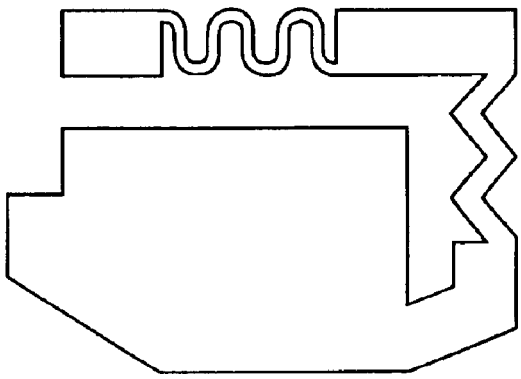
Figure 7B:
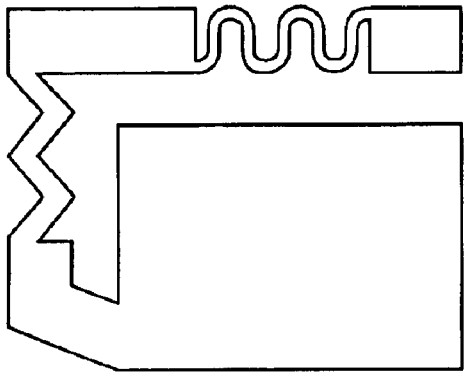

FIGS. 5–7 show various different embodiments of the radiating element of multi-band PIF antennas according to the present invention. For example, FIGS. 5A–D, 6C and 6E use a meandering form having a sinusoidal waveform shape placed in different parts of the L-shaped antenna element. FIGS. 5E and 5F use elongating sub-sections providing a triangular waveform shape placed in different parts of the L-shaped antenna element. Also, FIGS. 6A, 6B and 6D show elongating meander sub-sections having a rectangular waveform shape. FIGS. 6F, 7A and 7B each show two elongating meander sub-sections in the radiating element using combinations of differently shaped meandering sub-sections. More than one sub-section can be provided, as shown in FIGS. 6F, 7A and 7B. Multiple sub-sections can have the same or similar shapes or different shapes depending on the desired resonance frequency.

Figure 7C:
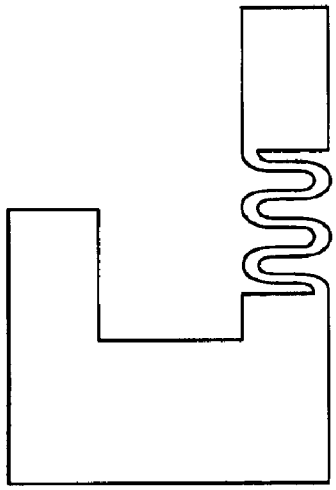

FIG. 7C shows yet another embodiment of the present invention. In this embodiment, the meander-like sub-section is provided within the substantially rectangular antenna element. Thus, depending on the placement of the ground connection, either the L-shaped element is elongated or the rectangular element is elongated.

It is contemplated and within the scope of the present invention that coupling to the radiating element at more than two contact locations may be utilized for increased bandwidth of the PIFA, according to the present invention.

The ground plane and/or the radiating element may have openings, e.g., holes or cutouts, therein for reduction of weight and/or attachment of mechanical support(s), e.g., dielectric insulating supports (not illustrated) holding the ground plane and/or the radiating element.

The present invention is not restricted to any one shape, size and/or form as shown in FIGS. 5–7. The ground plane and radiating element may be made of any type of conducting material, e.g., metal, metal alloys, graphite impregnated cloth, film having a conductive coating thereon, etc. The distance between the radiating element and the ground plane need not be constant. The multiple contact location embodiments of the present invention may also be used effectively in planar structures for push bend antenna configurations without an increase in fabrication costs.

The application of the elongating meandering sub-section is of course not limited to multi-band antennas but can also be used in any type of single-band antenna. Depending on the connection of the ground and "hot" connections, the antenna shown in FIG. 7C can be used, for example, as a single band antenna. Any other single band antenna using an antenna type similar to the above shown multi-band antennas can be modified according to the principles of the present invention.

As described above, the combination of different contact locations on the radiating element in multi-band antennas results in a multiple resonance, closely coupled, "stagger tuned" PIFA structure.

With the use of the meandering structure in the radiating element of the PIFA, the physical size or profile of the PIF antenna can stay the same while the resonance frequency can be lowered. Thus, a lower frequency range can be provided by the PIFA according to the invention without changing mechanical parts or making the phone size bigger in order to accommodate an otherwise larger antenna profile that would result if the invention were not used. Further, when a frequency change is not desired, existing phones can be built with an even smaller profile since the PIF antenna at a given operating frequency band with the meander structure requires a smaller volume than a PIF antenna without a meandering structure for the same operating frequency band.

The present invention has been described in terms of specific exemplary embodiments. In accordance with the present invention, the parameters for a system may be varied, typically with a design engineer specifying and selecting them for the desired application. Further, it is contemplated that other embodiments, which may be devised readily by persons of ordinary skill in the art based on the teachings set forth herein, may be within the scope of the invention, which is defined by the appended claims. The present invention may be modified and practiced in different but equivalent manners that will be apparent to those skilled in the art and having the benefit of the teachings set forth herein.

What is claimed is:

1. An antenna comprising:

a ground plane having a first planar surface and a first area; a radiating element having a second planar surface and a second area, wherein said second planar surface of said radiating element is substantially in parallel with the first planar surface of said ground plane and said second area comprises a section having a meandering form elongating the effective overall length of the radiating element; and a first connecting line coupled to a first edge of said ground plane and to a second edge of said radiating element at a first contact location; and a second connecting line coupled to the second edge of said radiating element at second and third contact locations.

2. The antenna according to claim 1, wherein the first area of said ground plane is greater than the second area of said radiating element.

3. The antenna according to claim 1, wherein the first area of said ground plane area is substantially the same as the second area of said radiating element.

4. The antenna according to claim 1, wherein the first contact location is between the second and third contact locations.

5. The antenna according to claim 1, further comprising the second connecting line being coupled to the second edge of said radiating element at a plurality of contact locations.

6. The antenna according to claim 1, wherein the first and second connecting lines are adapted for a desired impedance.

7. The antenna according to claim 6, wherein the desired impedance is about 50 ohms.

8. The antenna according to claim 1, wherein the second area of the radiating element comprises a first and a second section.

9. The antenna according to claim 8, wherein one of the sections comprises at least one sub-section elongating the effective length of the section.

10. The antenna according to claim 9, wherein said effective overall length comprises an effective overall electrical length.

11. The antenna according to claim 8, wherein the second section has a L-shaped form.

12. The antenna according to claim 1, wherein said section comprises a sinusoidal waveform shape.

13. The antenna according to claim 1, wherein said section comprises a triangular waveform shape.

14. The antenna according to claim 1, wherein said section comprises a rectangular waveform shape.

15. The antenna according to claim 1, wherein said ground plane is on one side of an insulating substrate and said radiating element is on the other side of the insulating substrate.

16. The antenna according to claim 15, wherein said ground plane, the insulating substrate and said radiating element are flexible.

17. The antenna according to claim 1, wherein the first area of said ground plane and the second area of said radiating element are rectangular.

18. The antenna according to claim 1, wherein the first area of said ground plane and the second area of said radiating element are non-rectangular.

19. The antenna according to claim 1, wherein said effective overall length comprises an effective overall electrical length.

20. A radio system having a plan inverted F antenna (PIFA), said system comprising:

a ground plane having a first planar surface and a first area; a radiating element having a second planar surface and a second area, wherein the second planar surface of said radiating element is substantially parallel with the first planar surface of said ground plane and the second area comprises a section having a meandering form elongating the effective overall length of the radiating element; a first connecting line coupled to a first edge of said ground plane and to a second edge of said radiating element at a first contact location; and a second connecting line coupled to the second edge of said radiating element at second and third contact locations, and first and second connecting lines are adapted to couple to a radio at a desired impedance.

21. The radio system according to claim 20, wherein said effective overall length comprises an effective overall electrical length.

22. The radio system according to claim 20, wherein said meandering form comprises a triangular waveform shape, a rectangular waveform shape, or a sinusoidal waveform shape.

23. An antenna comprising:

a ground plane having a first planar surface and a first area; a radiating element having a second planar surface and a second area, wherein said second planar surface of said radiating element is substantially in parallel with the first planar surface of said ground plane and said second area comprises a section located at the end of the area wherein said section is a meandering form elongating the effective overall length of the radiating element; and a first connecting line coupled to a first edge of said ground plane and to a second edge of said radiating element at a first contact location; and a second connecting line coupled to the second edge of said radiating element at second and third contact locations.

24. The antenna according to claim 23, wherein the first area of said ground plane is greater than the second area of said radiating element.

25. The antenna according to claim 23, wherein the first area of said ground plane area is substantially the same as the second area of said radiating element.

26. The antenna according to claim 23, wherein the first contact location is between the second and third contact locations.

27. The antenna according to claim 23, further comprising the second connecting line being coupled to the second edge of said radiating element at a plurality of contact locations.

28. The antenna according to claim 23, wherein the first and second connecting lines are adapted for a desired impedance.

29. The antenna according to claim 28, wherein the desired impedance is about 50 ohms.

30. The antenna according to claim 23, wherein said section consists of shapes selected from the group of: an L-shaped form, sinusoidal waveform shape, triangular waveform shape, and a rectangular waveform shape.

* * * * *